US009674601B2

(12) United States Patent
Park

(10) Patent No.: US 9,674,601 B2
(45) Date of Patent: Jun. 6, 2017

(54) PERSONAL AUDIO EQUIPMENT PROVIDED WITH AIR VENT UNIT AND NOISE CANCELLATION FUNCTION

(71) Applicant: Chung Man Park, Jeollanam-do (KR)

(72) Inventor: Chung Man Park, Jeollanam-do (KR)

( * ) Notice: Subject to any disclaimer, the term of this patent is extended or adjusted under 35 U.S.C. 154(b) by 0 days.

(21) Appl. No.: 14/914,477

(22) PCT Filed: Sep. 8, 2014

(86) PCT No.: PCT/KR2014/008437
§ 371 (c)(1),
(2) Date: Feb. 25, 2016

(87) PCT Pub. No.: WO2015/034335
PCT Pub. Date: Mar. 12, 2015

(65) Prior Publication Data

US 2016/0219361 A1 Jul. 28, 2016

(30) Foreign Application Priority Data

Sep. 9, 2013 (KR) ..... 10-2013-0107635

(51) Int. Cl.
*H04R 1/10* (2006.01)
*H04R 1/28* (2006.01)
(Continued)

(52) U.S. Cl.
CPC ..... *H04R 1/2823* (2013.01); *G10K 11/178* (2013.01); *H04R 1/1008* (2013.01);
(Continued)

(58) Field of Classification Search
CPC .... H04R 1/10; H04R 2205/022; H04R 1/105; H04R 5/0335; H04R 2201/10; H04R 2460/13; H04R 1/1016
(Continued)

(56) References Cited

U.S. PATENT DOCUMENTS 4,429,194 A * 1/1984 Kamon ..... H04R 1/1016 381/373
5,949,896 A * 9/1999 Nageno ..... H04R 1/1016 381/380
(Continued)

FOREIGN PATENT DOCUMENTS

KR 1020030077735 10/2003
KR 1020050083324 8/2004
(Continued)

*Primary Examiner* — Suhan Ni
(74) *Attorney, Agent, or Firm* — IPLA P.A.; James E. Bame

(57) ABSTRACT

A personal audio equipment provided with an air vent unit and a noise cancellation function, comprising: a sound reproduction unit in a form modified to have an air vent unit that may partly open an ear canal; a speaker cover unit; the air vent unit; a noise cancellation unit; and a sound wave sensor. Due to having the air vent unit penetrating the center of the audio equipment, the personal audio equipment provided with an air vent unit and a noise cancellation function is capable of discharging moisture, easily sensing outside sounds when not in use, effectively blocking the outside sounds by automatically operating the noise cancellation function during a phone conversation, and sensing sound waves, such as alert or horn sounds that require a user's attention, to thereby block the noise cancellation function when necessary.

5 Claims, 3 Drawing Sheets

(51) Int. Cl.
*G10K 11/178* (2006.01)
*H04R 25/00* (2006.01)
*H04R 29/00* (2006.01)

(52) U.S. Cl.
CPC ..... *H04R 1/1016* (2013.01); *H04R 1/1083* (2013.01); *H04R 25/00* (2013.01); *H04R 29/001* (2013.01); *H04R 2420/07* (2013.01); *H04R 2460/09* (2013.01); *H04R 2460/11* (2013.01)

(58) Field of Classification Search
USPC ..... 381/370–374, 379–380
See application file for complete search history.

(56) References Cited

U.S. PATENT DOCUMENTS

| | | | | | |
|---|---|---|---|---|---|
| 6,134,336 | A * | 10/2000 | Clark | H04R 9/02 | 381/371 |
| 6,668,064 | B1 * | 12/2003 | Lin | H04R 1/1016 | 381/373 |
| 7,162,051 | B2 * | 1/2007 | Grell | H04R 1/2842 | 381/370 |
| 8,447,058 | B1 * | 5/2013 | Sung | H04R 1/2826 | 381/370 |
| 2013/0163803 | A1 * | 6/2013 | Erdel | H04R 1/1091 | 381/373 |

FOREIGN PATENT DOCUMENTS

| | | |
|---|---|---|
| KR | 1020060064803 | 6/2006 |
| KR | 2020080000095 | 1/2008 |
| KR | 1020110115452 | 10/2011 |

* cited by examiner

PERSONAL AUDIO EQUIPMENT PROVIDED WITH AIR VENT UNIT AND NOISE CANCELLATION FUNCTION

BACKGROUND

The present disclosure relates to a personal audio equipment provided with an air vent unit and a noise cancellation function, and in particular to a personal audio equipment provided with an air vent unit and a noise cancellation function wherein an air vent unit is provided at a central portion of an earphone or a personal audio equipment, by means of which a user is able to easily hear an external sound even during the wearing thereof, and an external sound inputted via other vent portions except for a horn sound or an alarming sound can be cancelled using a noise cancellation function when a user is on the phone or is listening to a music using the earphone, thus preventing any accidents.

In case of a conventional personal audio equipment, the structure of an earphone or an audio equipment is changing focusing on the sealing of an earhole so as to prevent the input of external sound, etc. As described in the sealing type earphone of the Korean patent application number 10-2002-0016565, the structure of the earphone has been advanced up to a new structure which is able to maximize the blocking of an external sound input in such a way to seal the earhole when the earphone is inserted therein while enhancing a sound transfer function of the audio equipment. In case of a user who frequently is on the phone using a Bluetooth, an earphone, etc., the earphone remains blocked even when the user is not on the phone or is not listening to the music, so the user is not able to hear any external sound, for which any accident may occur. Any water or moisture which is naturally discharged to the outside via the earphone may not be discharged due to the sealing type personal audio equipment and may gather inside the earhole, which may result in the growth of bacteria having a bad effect on the health of the ears. In the summer, such phenomenon may cause the use to feel uncomfortable.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to solve the above-described problems associated with prior art.

It is an object of the present invention to provide a personal audio equipment provided with an air vent unit and a noise cancellation function, wherein an air vent unit is formed passing through a central portion of an audio equipment, which may allow any water or moisture to be discharged to the outside via an earhole, and a user is able to hear external sound when the earphone is not operating, and a noise cancellation function can be automatically carried out when the user is on the phone, whereupon external sound except for a horn sound or an alarming sound can be effectively blocked.

It is another object of the present invention to provide a personal audio equipment provided with an air vent unit and a noise cancellation function, wherein a user is able to hear external sound when the personal audio equipment is not operating after the wearing thereof, and any water or moisture gathering inside of a user's earhole can be discharged, and the external sound can be blocked so as to enhance a sound transfer function of the audio equipment when in use.

It is further another object of the present invention to provide a personal audio equipment provided with an air vent unit and a noise cancellation function, wherein when the personal audio equipment is in use, a horn sound or an alarming sound can be detected, and a noise cancellation function which is supposed to operate during the use of the personal audio equipment can be automatically stopped, whereupon the user is able to recognize any horn sound or alarming sound which the user should pay attention to.

To achieve the above objects, there is provided a personal audio equipment provided with an air vent unit and a noise cancellation function which may include, but is not limited to, an air vent unit which is provided passing through a central portion of an audio equipment inserted in a user's earhole, and a noise cancellation unit provided at an inner diameter portion of the air vent unit. In case of a user who uses the personal audio equipment being inserted in his earhole, the user is able to easily detect external sound when the personal audio equipment is not operating, and air can ventilate via the air vent unit, whereupon any water or moisture can be easily discharged, and when in use, the noise cancellation function works to block any external sound, by means of which the input of any external sound via the air vent unit can be prevented, so the sound from the audio equipment can be intensively transferred toward cochlear ducts.

Moreover, there is provided a personal audio equipment provided with an air vent unit and a noise cancellation function, which may include, but is not limited to, a sound wave detection sensor which is able to detect a sound wave of a horn sound or an alarming sound that a user should pay attention to during the use of a personal audio equipment. When a user is on the phone or is listening to the music by using the personal audio equipment, the sound wave detection sensor will detect a sound wave that the user should pay attention to, thus temporarily interrupting the noise cancellation function, whereby the user can recognize the soundwave that the user should pay attention to, with the aid of the air vent unit, thus preventing ant accidents.

The present invention is directed to a personal audio equipment provided with an air vent unit and a noise cancellation function, which equips with an air vent unit provided passing through a central portion of the personal audio equipment. The user is able to easily hear any external sound when the personal audio equipment is not operating after the wearing thereof, and air can ventilate via the air vent unit, thus preventing the accumulation of any water or moisture at a user's earhole. When the user is on the phone or is using the personal audio equipment, the noise cancellation function is automatically carried out, thus effectively blocking the input of the external sound, whereupon the sound from the audio equipment can be intensively transferred to cochlear ducts. Moreover, while the user is on the phone or is listening to the music by using the personal audio equipment, any horn sound or alarming sound can be selectively transferred, which makes it possible to previously prevent any accident.

The advantageous effects of the present invention are not limited to the above-described effects, and various effects may be further provided within a range where a person having ordinary skill in the art can draw from the descriptions below.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Legend Of Reference Numbers

Figure 1:
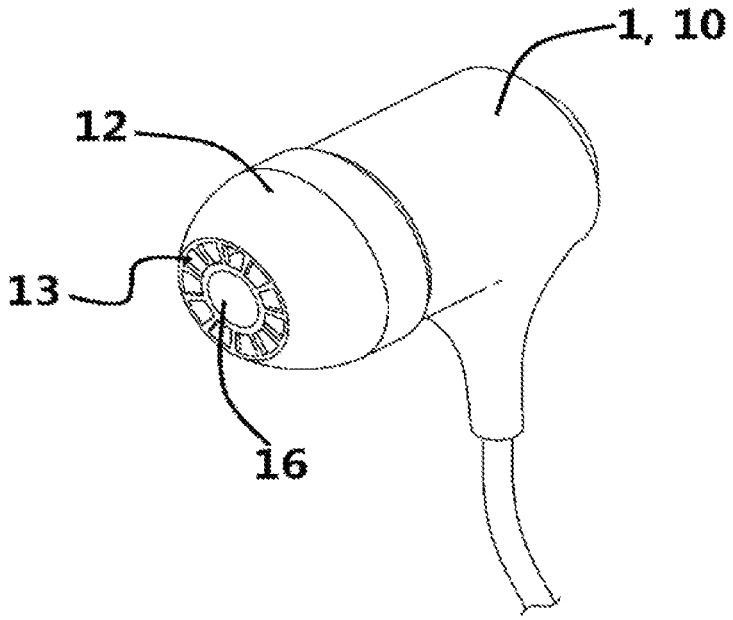
FIG. 1 is a perspective view illustrating a personal audio equipment provided with an air vent unit and a noise cancellation function according to the present invention.
Figure 2:
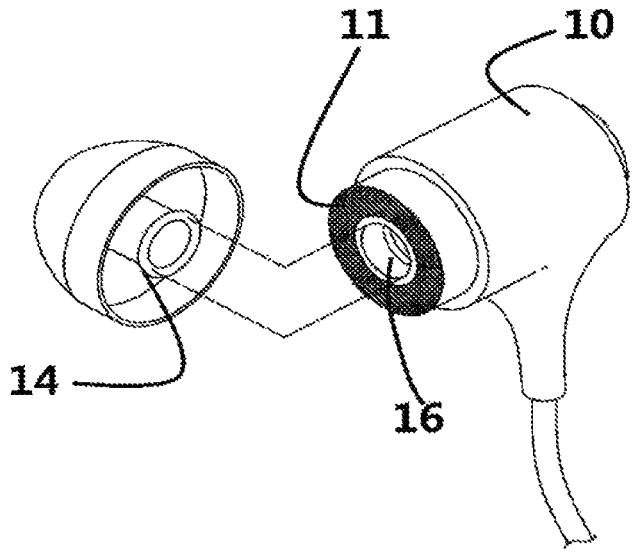
FIG. 2 is a disassembled view illustrating a personal audio equipment provided with an air vent unit and a noise cancellation function.

1: Ear phone
10: Speaker cover unit (an outer shell)
11: Sound regeneration unit
12: Speaker earhole insertion unit
13: Speaker earhole insertion unit sound transfer unit
14: Speaker earhole insertion unit engaging unit
15: Electric wire unit 16: Air vent unit
17: Noise cancellation unit
20: Noise 30: Bluetooth It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

The preferred embodiments of the present invention will be described with reference to the accompanying drawings.

The present invention is directed to a personal audio equipment provided with an air vent unit and a noise cancellation function which may include, but is not limited, an audio equipment cover, a sound regeneration unit and an electric wire unit which are the components of a conventional personal audio equipment. In addition to that, the present invention may include, but is not limited to, a sound regeneration unit 11 which is transformed a little to form an air vent unit which is able to partially open a part of an earhole, a speaker cover unit 10, an air vent unit 16, a noise cancellation unit 17, and a sound wave detection sensor (not illustrated).

Figure 3:
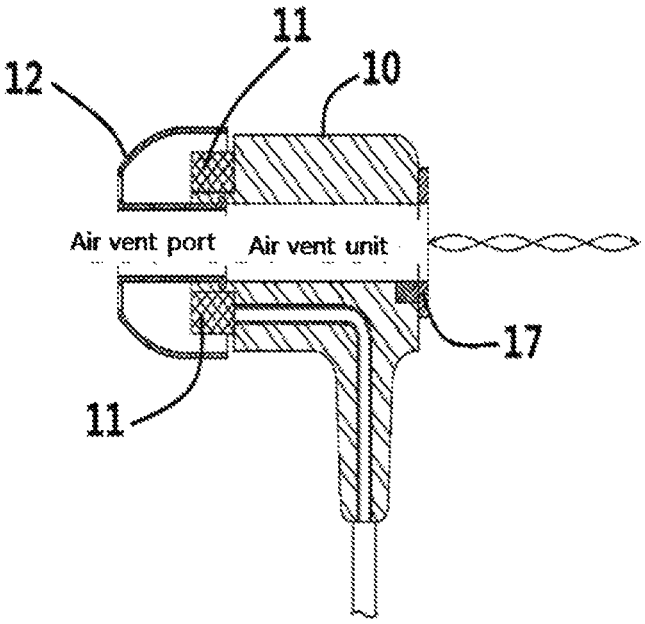
FIGS. 3 and 4 are inner side views illustrating an air vent unit of a personal audio equipment provided with an air vent unit and a noise cancellation function.
Figure 4:
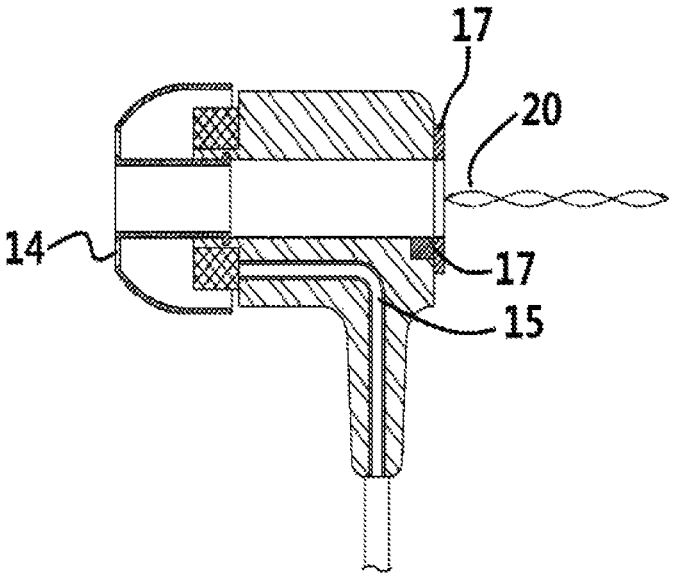
Figure 5:
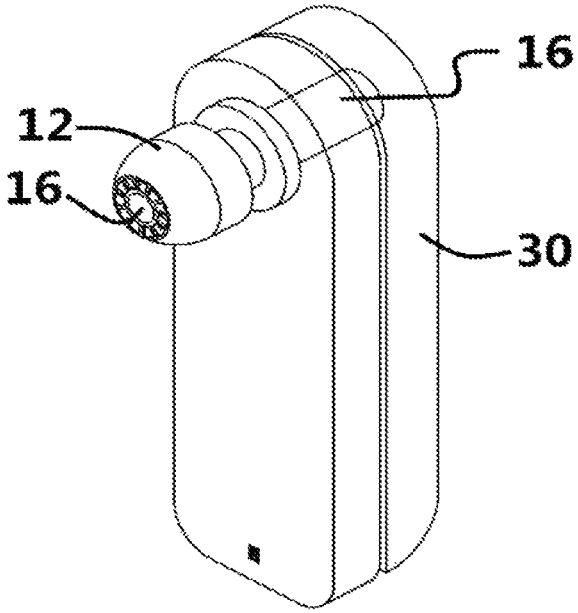
FIG. 5 is a view illustrating a Bluetooth device provided with an air vent unit.

More specifically, an electric wire unit 15 is provided, which is able to transfer an electric signal to a sound regeneration unit. The air vent unit 16 is formed passing through the central portions of the speaker cover unit 10 and the sound regeneration unit 11. Different from a conventional personal audio equipment wherein the sound regeneration unit is provided at a central portion, and the speaker cove unit is covering the same, as illustrated in FIG. 3, the central portions of the sound regeneration unit 11, the speaker cover unit 10 and the speaker earhole insertion unit 12 are being passed through in a donut shape. Since the central portion of the sound regeneration unit 11 is being passed through in a donut shape, and the speaker earhole insertion unit 12 equips with the air vent unit 16 the central portion of which is being passed through, thus forming a pore for the sake of sound transfer. The pore is provided to transfer sound generated by the sound regeneration unit 11. The sound may be transferred to the cochlear ducts via the speaker earhole insertion unit sound transfer unit 13. Moreover, the earhole insertion unit equips with an engaging unit 14 for the sake of an effective engagement with the speaker cover unit 10.

The air vent unit 16 is provided, which is passing through a central portion of the earhole insertion type audio equipment, and the noise cancellation unit 17 is provided inside of the air vent unit. In case of the user who is wearing the personal audio equipment in the earhole, the user can easily recognize external sound or any noise 20 when it is not operating, and since air can ventilate via the air vent unit 16, any water or moisture can be discharged via the earhole. When in use, a noise cancellation function will be activated so as to emit waveforms which will be offset with a corresponding soundwave in such a way to detect and analyze the waveform of external sound, by which the external sound transferred via the air vent unit can be cancelled, so the sound from the audio equipment can be intensively transferred toward the cochlear ducts.

The present invention equips with a soundwave detection sensor (not illustrated) which is able to detect any soundwave of a horn sound or an alarming sound that the user should pay attention to while the user is on the phone or is listening to the music using the personal audio equipment. The soundwave that the user should pay attention to is detected, and the noise cancellation function is temporarily interrupted, by means of which the soundwave that the user should pay attention to can be transferred to the user via the air vent unit, thus preventing any accident in advance.

The present invention is directed to a personal audio equipment provided with an air vent unit and a noise cancellation function and can be employed to all kinds of audio equipment, for example, a hearing aid, an earphone, a headphone, etc. which is used inserted in the user's earhole or is used covering the user's earhole.

Moreover, since the components of the soundwave detection sensor and the noise cancellation unit, the operation methods thereof and the method for controlling the operation of the noise cancellation unit using the soundwave detection sensor may be obviously drawn from the known technologies, the descriptions thereon will be omitted.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A personal audio equipment provided with an air vent unit and a noise cancellation function and configured to be inserted in a user's earhole or be used hung around a user's ear, comprising:

a donut-shaped sound regeneration unit;

an electric wire unit which is able to transfer an electric signal to the sound regeneration unit; and a speaker cover unit in which the sound regeneration unit is installed inserted, wherein an air vent unit is provided at a central portion of the speaker cover unit, and when the personal audio equipment is before operating after a user has worn, an external sound or noise (20) is directly transferred to cochlear ducts via the air vent unit of the speaker cover unit and the earhole and is detected, and the earhole is dried with the aid of ventilation, wherein in case of a user who uses the personal audio equipment being inserted in his earhole, an external sound or noise is easily transferred to cochlear ducts via the air vent unit when not in use, and air ventilation is carried out, so the earhole is dried, and a noise cancellation unit, for emitting waveforms which will be offset with a corresponding soundwave in such a way to detect and analyze the waveform of external sound so as to cancel the external sound transferred via the air vent unit, is provided inside of the air vent unit, by means of which in case where the user is on the phone or is listening to the music using the audio equipment, the noise, mixed sound or external sound being transferred to the cochlear ducts via the air vent unit is blocked, and the sound from the audio equipment is intensively transferred to the cochlear ducts in such a way that the noise transferred via the air vent unit is detected, and an opposing wave is emitted, thus offsetting the noise.

2. The equipment of claim 1, wherein the function of the noise cancellation unit is temporarily interrupted in such a way to detect a soundwave that a user should pay attention while the user is on the phone or is listening to the music using the audio equipment, by means of which a soundwave that the user should pay attention during the use of the audio equipment is transferred via the air vent unit.

3. The equipment of claim 1, further comprising:

a speaker earhole insertion unit engaging unit which is able to be engaged to the air vent unit and a speaker cover unit;

a speaker earhole insertion unit sound transfer unit which is able to transfer the sound from a sound regeneration unit to the earhole, not interrupting the sound; and a speaker earhole insertion unit which is formed of the air vent unit together with a speaker case in order for the sound transferred via the air vent unit of the speaker case not to be interrupted.

4. The equipment of claim 1, wherein the personal audio equipment includes an earphone, a Bluetooth, a hearing aid or an audio equipment which is inserted in the earhole or is hung covering the earhole.

5. The equipment of claim 2, wherein the personal audio equipment includes an earphone, a Bluetooth, a hearing aid or an audio equipment which is inserted in the earhole or is hung covering the earhole.

* * * * *